US005742301A

United States Patent [19]

Ikeda

[11] Patent Number: 5,742,301

[45] Date of Patent: Apr. 21, 1998

[54] INK JET PRINTING METHOD AND APPARATUS

[75] Inventor: Kunihiko Ikeda, Kodaira, Japan

[73] Assignee: Canon Kabushiki Kaisha, Tokyo, Japan

[21] Appl. No.: 443,270

[22] Filed: May 17, 1995

[30] Foreign Application Priority Data

May 20, 1994 [JP] Japan ..... 6-106600

[51] Int. Cl.[6] ..... B41J 29/38; B41J 2/01

[52] U.S. Cl. ..... 347/9; 15/104

[58] Field of Search ..... 347/9, 15, 16, 347/104

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,475,128 | 10/1984 | Koumura | 347/104 |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,155,503 | 10/1992 | Tasaki et al. | 347/16 |

FOREIGN PATENT DOCUMENTS

| | | | |
|---|---|---|---|
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 61-00836 | 1/1986 | Japan | 347/9 |

*Primary Examiner*—Valerie Lund

*Attorney, Agent, or Firm*—Fitzpatrick, Cella, Harper & Scinto

[57] ABSTRACT

An ink jet apparatus is provided for printing on both surfaces or one surface of a sheet-shaped printing medium by using an ink jet head including a plurality of ink ejecting ports facing the printing medium and energy generating elements. The apparatus comprises a printing density changing section for changing a printing density on the printing medium, a both surface/one surface printing mode designating section for designating either of a both surface printing mode for printing on both surfaces of the printing medium and a one surface printing mode for printing on one surface of the printing medium, a printing density selecting device for selecting a low printing density when the both surface printing mode is designated by the both surface/one surface printing mode designating section, the printing density being selectable between a normal printing density and a low printing density lower than the normal printing density, and a controlling section for actuating the printing density changing section such that the printing density becomes the printing density selected by the printing density selecting section. With this construction, an occurrence of striking through cannot be markedly recognized as desired.

22 Claims, 5 Drawing Sheets

INK JET PRINTING METHOD AND APPARATUS

FIELD OF THE INVENTION

1. Background of the Invention

The present invention relates generally to an ink jet printing method and apparatus. More particularly, the present invention relates to an ink jet printing method and apparatus for ejecting ink toward a printing medium from an ink jet head in response to printing information to print the latter on the printing medium.

2. Description of the Related Art

Conventionally, a printing apparatus arranged on a printer, a copying machine or the like is constructed such that an image is printed on a printing sheet based on the printing information. The printing apparatus is typically classified into an ink jet type, a wire dot type, a thermal type and a laser beam type depending on a printing system employed therefor. Among them, a printing apparatus operable in accordance with an ink jet system performs printing by ejecting ink from an ink jet head to a printing sheet. The ink jet type printing apparatus can produce the following advantages. One of them is that the ink jet head can be easily made compact. Another advantage is that printing information can be printed not only with high resolution but also at a high speed. Another advantage is that a running cost is low. Another advantage is that little noise is generated from the printing apparatus attributable to a non-impact system. In particular, a further advantage is that color printing information can be easily printed by using multi-colored inks.

Generally, in the printing apparatus of the above-described type, only one surface of the printing sheet has been printed in many cases. In recent years, however, as an ecology movement is promoted, there is increasing demand for the capability of allowing both surfaces of a single printing sheet to be printed from the viewpoint of saving paper resources. Under such circumstances, the tendency is that both surfaces of the printing sheet are printed in the ink jet apparatus. However, since liquid ink is used in such type of the method, a problem arises that printed information is readily recognized from the opposite side depending on the material of the printing sheet, i.e., a printing medium and the kind of inks. Especially, when printed information has a high density or a printing sheet is thin, another problem arises that initially printed information is hardly recognized because of striking through, or printing quality is degraded.

OBJECT OF THE INVENTION

In view of the aforementioned problems, the present invention has been made to resolve the problems.

An object of the present invention is to provide an ink jet printing method and apparatus which ensure that in the case that both surfaces of a printing sheet are printed, an occurrence of striking through can not be markedly recognized as desired.

SUMMARY OF THE INVENTION

According to a first aspect of the present invention, there is provided an ink jet printing method of printing both surfaces or one surface of a sheet-shaped printing medium by using an ink jet head including a plurality of ink ejecting ports facing the sheet-shaped printing medium and an energy generating element for ejecting ink through ink ejecting ports to the printing medium, the method comprising the steps of designating either of a both surface printing mode for printing both surfaces of the printing medium and a one surface printing mode for printing one surface of the printing medium, selecting a low printing density on the printing medium when the both surface printing mode is designated, the printing density being at least selectable between a normal printing density and the low printing density lower than the normal printing density, and changing the printing density on the printing medium to the selected printing density.

Here, the ink jet printing method may further include the step of cancelling the low printing density selected by designating the both surface printing mode, and permitting to select the normal printing density.

It is preferred that in the case that the both surface printing mode is not designated, the normal printing density is to be selected.

Incidentally, the step of changing the printing density on the printing medium is to change an amount of ink per unit area ejected for printing. Reduction of an ink amount per unit area is effective in reducing the printing density. The printing density can be reduced by thinning ink dots formed on the printing medium, or by shortening a driving time duration of the thermal energy generating element. Further, the method of the present invention may further comprise the step of detecting a temperature of the ink jet head and keeping the temperature of the ink jet head at a temperature lower than that for the normal printing density so that the printing density is reduced. In such case, the method of the present invention may further comprise the step of heating the ink jet head based upon information on the temperature of the ink jet head.

It is preferred that the energy generating element is an electrothermal transducer for generating thermal energy to allow a phenomenon of film boiling to appear in ink.

On the other hand, according to a second aspect of the present invention, there is provided an ink jet apparatus for printing both surfaces or one surface of a sheet-shaped printing medium by using an ink jet head including a plurality of ink ejecting ports facing the printing medium and an energy generating element for ejecting ink from the ink ejecting ports to the printing medium, the ink jet apparatus comprising printing density changing means for changing a printing density, both surface/one surface printing mode designating means for designating either of a both surface printing mode for printing both surfaces of the printing medium and a one surface printing mode for printing one surface of the printing medium, printing density selecting means for selecting a low printing density on the printing medium when the both surface printing mode is designated by the both surface/one surface printing mode designating means, the printing density being at least selectable between a normal printing density and the low printing density lower than the normal printing density, and controlling means for actuating the printing density changing means to provide the printing density selected by the printing density selecting means.

Here, the apparatus of the present invention may further comprise normal printing density selecting means for cancelling the low printing density selected by the both surface printing mode designating means and permitting to select the normal printing density. It is preferred that when the both surface printing mode is not designated by the both surface/one surface printing mode designating means, the normal printing density is to be selected by the printing density selecting means.

Incidentally, the printing density changing means is provided to change an amount of ink per unit area ejected for printing. An ink amount per unit area is reduced to reduce the printing density. The printing density changing means can reduce the printing density by thinning ink dots formed on the printing medium, or by shortening a driving time duration of the thermal energy generating element. Further, the ink jet apparatus may further comprise temperature detecting means for detecting a temperature of the ink jet head. The printing density changing means can reduce the printing density by keeping the ink jet head at a temperature lower than that for the normal printing density. In this case, it is effective that the ink jet apparatus may further comprise a subheater capable of heating the ink jet head based on information from the temperature detecting means.

It is preferred that the energy generating element is an electrothermal transducer for generating thermal energy to allow a phenomenon of film boiling to appear in ink.

According to the present invention, when the both surface printing mode for printing both surfaces of the printing medium is designated by the both surface/one surface printing mode designating means, the printing density selecting means selects the low printing density. Then, the controlling means actuates the printing density changing means to provide the low printing density selected by the printing density selecting means.

More specifically, the printing density changing means is actuated so as to reduce the printing density on the printing medium by thinning ink dots formed on the printing medium or by shortening the driving time duration for the thermal energy generating element of the ink jet head or by keeping the ink jet head at a temperature lower than that for the normal printing density. With this construction, when both surfaces of the printing medium are printed with information, there does not arise striking through with the printing medium.

Incidentally, if the both surface printing mode is specified by the both surface/one surface printing mode designating means but the low printing density is not desired, the low printing density selected by the printing density selecting means is cancelled by the normal printing density selecting means and the normal printing density is selected. With such structure, printing at the normal printing density can be achieved even in the both surface printing mode.

The above and other objects, effects, features and advantages of the present invention will become more apparent from the following description of embodiments thereof taken in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments thereof.

Figure 1:
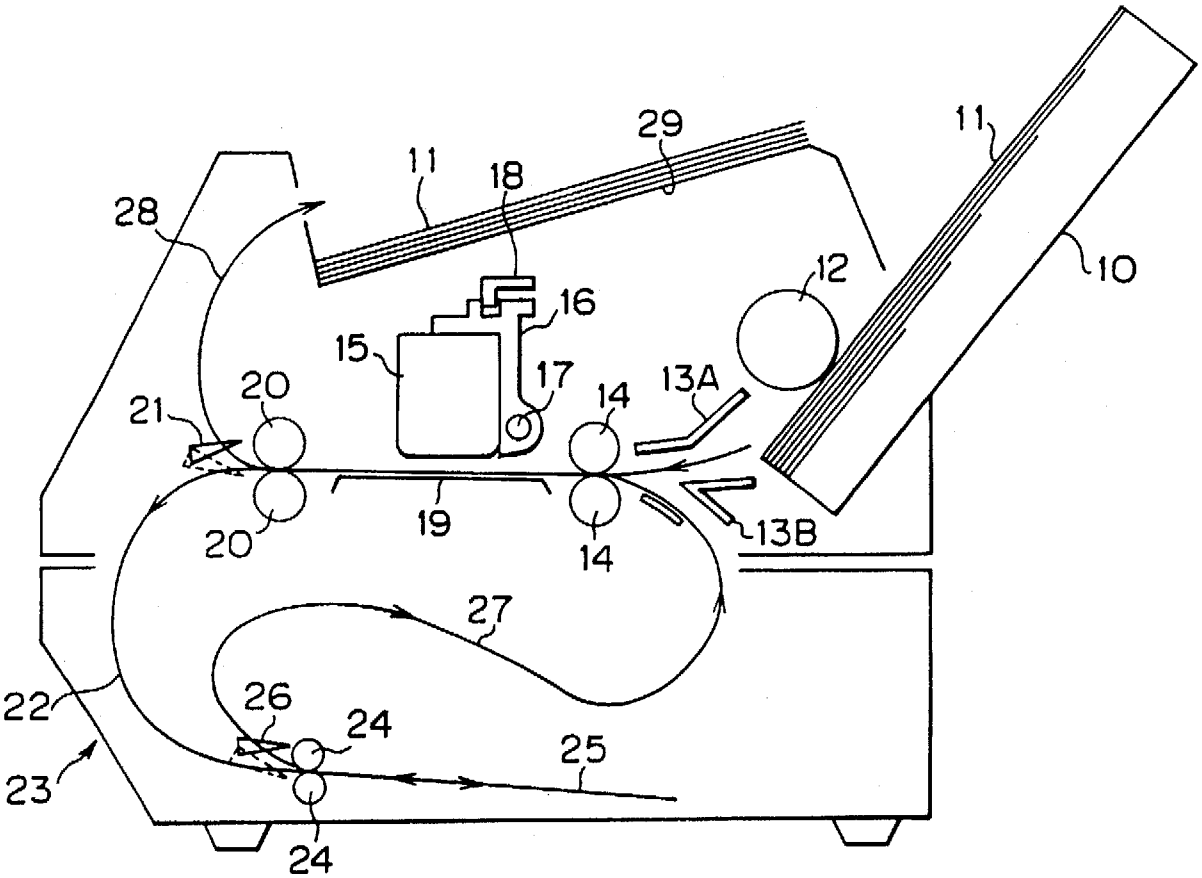
FIG. 1 is a schematic view which illustrates the structure of a first embodiment wherein an ink jet apparatus of the present invention is applied to a printer.

In FIG. 1, reference numeral 10 denotes a cassette in which printing sheets 11 are received in the laminated state. The printing sheets 11 received in the cassette 10 are delivered from the cassette 10 one by one from the uppermost side by rotating a paper feeding roller 12. As the printing sheet 11 is delivered by the paper feeding roller 12, it is conveyed to a printing position by an opposing pair of conveying rollers 14 past the clearance between an upper guide 13A and a lower guide 13B. The conveying rollers 14 serve to convey the printing sheet 11 to the printing position by a predetermined quantity.

An ink jet head 15 is displaceably held at the printing position as means for printing printing information on the printing sheet 11 conveyed by the conveying roller 14 while it is mounted on a carriage 16. The ink jet head 15 includes fine ink ejecting ports, an ink path and energy generating means using an electrothermal transducer disposed at a portion of the ink path, for ejecting ink by heating (not shown). The displacement of the carriage 16 is guided with the aid of a guide shaft 17 and a guide rail 18, and the carriage 16 is reciprocably displaced by a carriage driving motor 6 (see FIG. 2) and a feeding mechanism in the vertical direction relative to the paper surface of FIG. 1. Reference numeral 19 denotes a platen which is disposed at the printing position in a facing relation with the ink jet head 15. The printing sheet 11 is supported by the platen 19 from the back surface side.

The printing sheet 11 having printing information printed thereon is conducted to a first flapper 21 by rotating an opposing pair of discharging rollers 20.

In the case that a both surface printing mode is selected, the first flapper 21 is shifted to the position represented by solid lines in the drawing, so that the printing sheet 11 is delivered to a paper refeeding section 23 via a conveyance path 22. Then, the printing sheet 11 is delivered to a reversing pocket 25 by rotating an opposing pair of normal/reverse rotating rollers 24 in the normal direction. Subsequently, by rotating the normal/reverse rollers 24 in the reverse direction and shifting a second flapper 26 from the position represented by solid lines to the position represented by phantom lines, the orientation of the printing sheet 11 is reversed so that the printing sheet 11 is returned to the conveying rollers 14 via an S-shaped conveyance passage 27 and conducted onto the platen 19 again. After printing information is printed on the opposite surface of the printing sheet 11 to the preceding one, the printing sheet 11 is upwardly conveyed via a conveyance path 28 with the aid of the first flapper 21 shifted to the position represented by phantom lines, so that it is successively placed on a discharging tray 29.

On the contrary, in the case that a one surface printing mode is selected, after printing information is printed on the printing sheet 11 by the ink jet head 15, the printing sheet 11 is discharged directly on the discharging tray 29 along a conveyance path 28 via the first flapper 21 shifted to the position represented by phantom lines and successively placed on the discharging tray 29.

In the case that printing information are printed on both the front and back surfaces of the printing sheet 11, to prevent an occurrence of striking through, a printing operation is performed in accordance with a striking through preventing mode in the following manner as desired.

Figure 2:
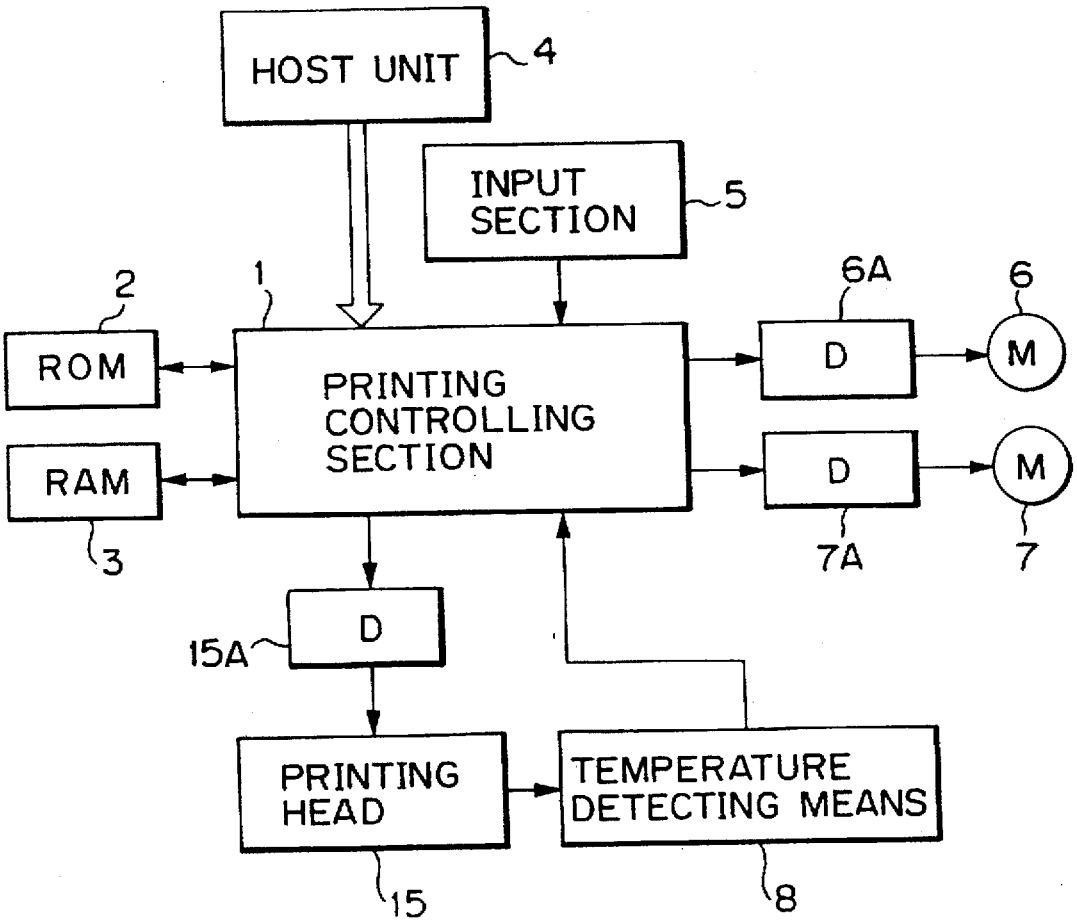
FIG. 2 is a control block diagram which illustrates the first embodiment of the present invention.

FIG. 2 illustrates the structure of a printing controlling circuit for the printer constructed in accordance with the first embodiment of the present invention. In FIG. 2, reference numeral 1 denotes a printing controlling section for controlling printing operations of the printer in this embodiment, reference numeral 2 denotes a ROM serving as memorizing means and having various programs stored therein when the printer is controlled by the print controlling section 1, reference numeral 3 denotes a RAM likewise serving as memorizing means having data and information from a host unit 4 temporarily stored therein for performing printing, and reference numeral 5 denotes an input section for instructing shifting operations of various modes to the printing controlling section 1. In addition, reference numeral 6 denotes a carriage driving motor, reference numeral 7 denotes a motor for driving the conveyance rollers 14 and the discharging rollers 20 for feeding, conveying and discharging the printing sheets 11, reference numerals 6A and 7A denote drivers, reference numeral 15A denotes a driver for an ink jet head 15, and reference numeral 8 denotes temperature detecting means for detecting the temperature of the ink jet head 15. The printing controlling section 1 can control the printer in such a manner as to change a printing signal to be fed to the ink jet head driver 15A based on the detection information from the temperature detecting means 8.

Figure 3:
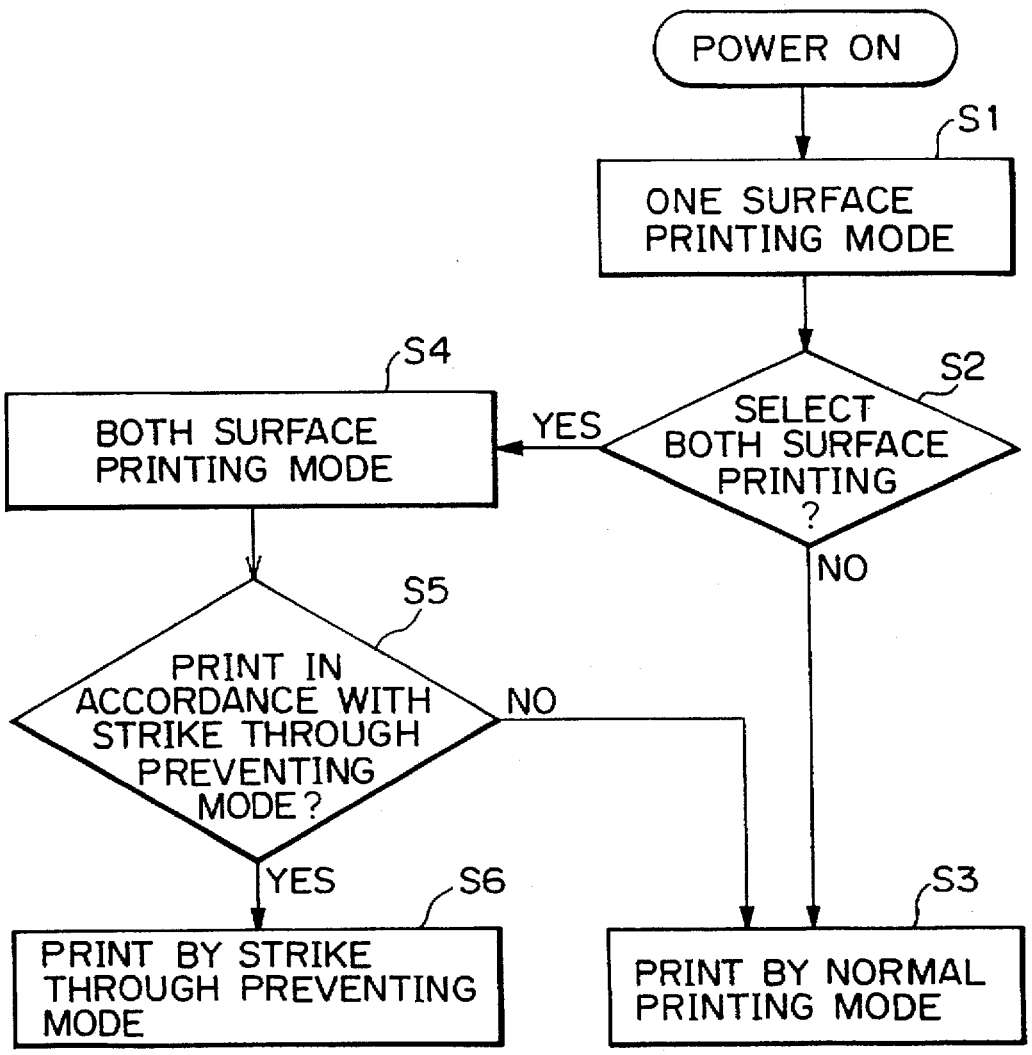
FIG. 3 is a flowchart which illustrates a controlling procedure in accordance with the first embodiment of the present invention.

Next, the procedure for controlling a printing processing mode for the printing sheet 11 will be described below with reference to FIG. 3.

When a power source is turned on, the program advances to Step S1. The ink jet printing apparatus is automatically set in a one surface printing mode. As long as a both surface printing mode is not required via the input section 5, the program goes to Step S3 via Step S2 so that a printing operation is performed in accordance with a normal printing mode with high speed/high quality preset therefor.

On the other hand, in the case that the both surface printing mode is required, the program goes from Step S2 to Step S4 to select the both surface printing mode in a striking through preventing mode (a low density printing mode). According to the present embodiment, even if the both surface printing mode is selected, it is possible to cancel the striking through preventing mode and perform printing at the normal density. Consequently, in Step S5, it is judged whether normal printing is required or not.

In the case that normal printing having the same high speed/high quality as that in the one surface printing mode is required in Step S5, the program goes to Step S3 in which a printing operation is performed in accordance with a normal printing mode having the same high speed/high quality as that in the one surface printing operation. In the case that the normal printing is not required in Step S5, the program goes to Step S6 to perform printing at a low density (as will be described later) which is set in advance such that no striking through occurs.

Next, an embodiment for performing a low density printing operation corresponding to the striking through preventing mode will be described below.

Figure 4:
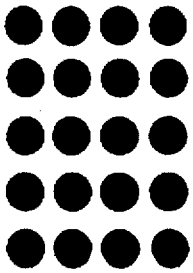
FIG. 4 is a schematic view which illustrates the arrangement of dots representing printing information during normal printing with a high quality in accordance with the first embodiment of the present invention.
Figure 5:
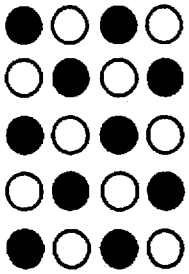
FIG. 5 is a schematic view which illustrates the arrangement of dots representing printing information during printing at a low density in accordance with the first embodiment of the present invention.

FIG. 5 illustrates the distribution state of printed dots as a first embodiment for realizing a low density printing operation. Specifically, in this embodiment, by performing the same draft printing as that used at the time of a high speed mode that is a normal printing mode, apparent low density printing is achieved to prevent an occurrence of striking through. Provided that ○ portions are printed dot portions in a printing pattern having a matrix structure as shown in FIG. 4, portions as represented by ● in FIG. 5 are printed by thinning in a zigzag pattern in accordance with a high speed mode by reducing a heating period usable for recording to a level of half. At this time, since the number of printed dots is reduced to a half, apparent printing density is lowered. In addition, since a quantity of ink absorbed in the printing sheet is reduced, striking through is not markedly recognized. It should be noted that such draft printing is not necessarily performed in accordance with a high speed mode, and an exclusive thinning method having little possibility of an occurrence of striking through may be employed.

Figure 6:
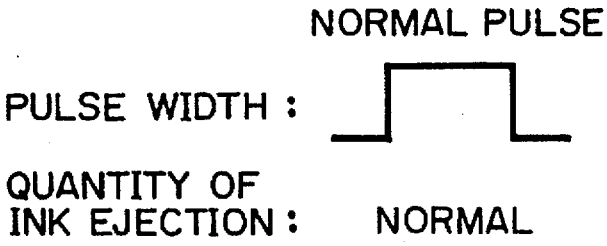
FIG. 6 is a waveform diagram representative of a pulse pattern of a driving voltage to be applied to an ink jet head during normal printing in accordance with a second embodiment of the present invention.
Figure 7:
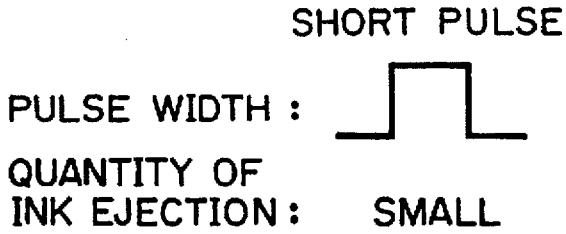
FIG. 7 is a waveform diagram representative of a pulse pattern of driving voltage to be applied to an ink jet head during low density printing in accordance with the second embodiment of the present invention.

FIG. 6 and FIG. 7 show an example of changing the pulse width of driving voltage applied to an electrothermal transducer of the ink jet head, as a second embodiment capable of realizing low density printing. Specifically, this embodiment is intended to reduce a quantity of ink ejection by controlling via the head driver 15A the pulse width of the driving voltage to be applied to electrothermal transducer that is energy generating means, in such a manner that the pulse width is preliminarily shortened as shown in FIG. 7 from the state shown in FIG. 6, in order to prevent an occurrence of striking through. Now, when it is assumed that the wave shape shown in FIG. 6 represents the pulse width of driving voltage in a normal printing mode, FIG. 7 shows the pulse width of driving voltage in a striking through preventing mode associated with the both surface printing mode. Compared with the pulse width of driving voltage in the normal printing mode, the pulse width becomes a pulse width having a short time. Thus, the printing density can be reduced by reducing a quantity of ink ejection during printing. Consequently, an occurrence of striking through is not markedly recognized at the time of both surface printing.

Incidentally, the driving voltage pulse width at this time is preliminarily set to such an extent that the printing quality is not degraded so much. Also, in the case that ejection controlling is performed by a plurality of driving voltage pulses but not by a single driving voltage pulse as shown in FIG. 6 and FIG. 7, a quantity of ink ejection can be reduced by controlling the driving voltage pulse width in the same manner as described above.

Figure 8:
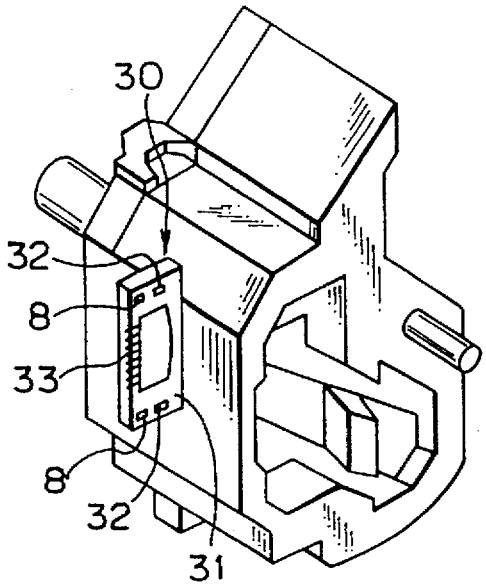
FIG. 8 is a perspective view which shows the structure of an ink jet head section constructed in accordance with a third embodiment of the present invention.

FIG. 8 shows an appearance of an ink jet head as a third embodiment capable of realizing low density printing. This embodiment is an example applied to an ink jet apparatus of the type wherein the temperature of the ink jet 15 is detected by temperature sensors 8 disposed in the vicinity of the electrothermal transducer of the ink jet head 15 to serve as temperature detecting means so that the pulse width of driving signal applied to the electrothermal transducer of the ink jet head 15 is controlled in response to the detected temperature. In the case of this embodiment, a difference is previously determined between a reference temperature of the ink jet head 15 at the time of the normal printing mode and a reference temperature of the ink jet head 15 at the time of the striking through preventing mode so that an occurrence of striking through can be prevented by reducing a quantity of ink ejection at the time of the striking through preventing mode.

In FIG. 8, reference numeral 30 denotes an ink ejecting portion of the ink jet head 15, reference numeral 31 designates a silicon matrix of the ink ejecting portion 30, and reference numeral 32 designates a subheater disposed on the silicon matrix 31 together with temperature sensors 8. The temperature sensors 8 detect a temperature of the ink ejecting portion 30. In order to eject an optimum quantity of ink from a plurality of ink ejecting ports 33, when the temperature of the ink ejecting portion 30 is higher than the preset reference temperature, the driving voltage pulse width of the electrothermal transducer is corrected in response to the temperature in order to suppress a quantity of ink ejection. In the case that the temperature of the ink ejecting portion 30 is lowered due to the influence of environmental temperature or the like, controlling is effected such that the pulse width of driving voltage applied to the electrothermal transducer is enlarged or the subheater 32 is driven to elevate the temperature of the ink ejection portion 30 to increase a quantity of ink ejection as desired. It is recommendable that at the time of both surface printing mode, the reference temperature is preliminarily set lower than that at the time of the normal printing mode. In this manner, a quantity of ink ejection can be suppressed much more than that at the normal printing time so that an occurrence of striking through can not be markedly recognized.

Figure 9:
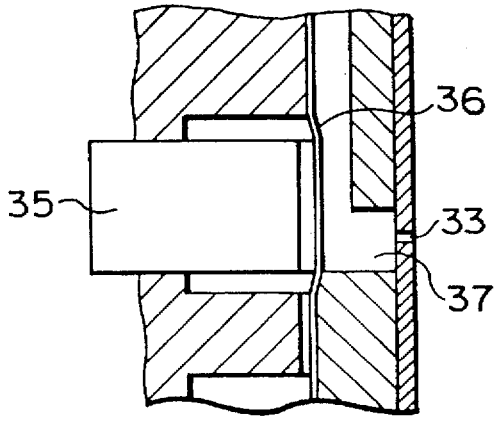
FIG. 9 is a fragmentary sectional view which illustrates components located in the vicinity of ink ejecting ports of an ink jet head constructed in accordance with a fourth embodiment of the present invention.

FIG. 9 shows a fourth embodiment for realizing low density printing at the time of the both surface printing mode. This embodiment is an application example in the case that a piezo-electric element 35 is disposed as energy generating means for ejecting ink droplets, and by controlling the driving voltage applied to the piezo-electric element 35, a quantity of ink ejection can be reduced while preventing an occurrence of striking through.

In this embodiment, as driving voltage is applied to the piezo-electric element 35, a pressure wall 36 molded of an elastic material is displaced to eject ink in an ink chamber 37 through an ink ejecting port 33. In the both surface printing mode, a quantity of ink ejection can be reduced by lowering the voltage applied to the piezo-electric element 35, thus reducing printing density, so that an occurrence of striking through can not be markedly recognized.

In each of the aforementioned embodiment, one kind of striking through preventing mode for low density printing is set in association with the normal printing mode. In order to attain low density printing stepwisely, a plurality of striking through preventing modes may be set so that a user can arbitrarily make selection from these modes depending upon printing conditions.

In such manner, since there is provided controlling means for controlling operations of printing density changing means such that when the both surface printing mode is designated by the both surface/one surface printing mode designating means, a low printing density is selected by printing density selecting means and the printing density becomes the printing density selected by the printing density selecting means. Thus, the present invention can provide an ink jet apparatus which has the following advantages. In the both surface printing mode, deterioration of printing quality is prevented. An occurrence of striking through can not be markedly recognized by adequately suppressing the printing density. The ink jet apparatus of the present invention can be conveniently used by a user while preventing an occurrence of striking through.

In the ink jet apparatus of the above-described embodiment, the electrothermal transducer for generating thermal energy is used as an energy generating element to achieve printing at a high density and with high resolution. The present invention is also applicable to an ink jet apparatus which uses an electromechanical transducer such as a piezo-electric element.

A typical structure and a principle of the above-mentioned ink jet apparatus using electrothermal transducers and laser beams are disclosed in U.S. Pat. Nos. 4,723,129 and 4,740,796, and it is preferable to use this basic principle to implement such a system. Although this system can be applied either to on-demand type or continuous type ink jet apparatus, it is particularly suitable for the on-demand type apparatus. This is because the on-demand type apparatus has electrothermal transducers, each disposed on a sheet or ink passage that retains ink, and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the ink jet head; and third, bubbles are grown in the ink corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of an ink jet head, which is incorporated to the present invention: this structure includes heating portions disposed on bent portions in addition to a combination of the ejection orifices, ink passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the ink jet head, the present invention can achieve printing positively and effectively.

The present invention can be also applied to a so-called full-line type ink jet head whose length equals the maximum length across an ink jet medium. Such an ink jet head may consists of a plurality of ink jet heads combined together, or one integrally arranged ink jet head.

In addition, the present invention can be applied to various serial type ink jet heads: an ink jet head fixed to the main assembly of an ink jet apparatus; a conveniently replaceable chip type ink jet head which, when loaded on the main assembly of an ink jet apparatus, is electrically connected to the main assembly, and is supplied with ink therefrom; and a cartridge type ink jet head integrally including an ink reservoir.

It is further preferable to add a recovery system, or a preliminary auxiliary system for an ink jet head as a constituent of the ink jet apparatus because they serve to make the effect of the present invention more reliable. Examples of the recovery system are a capping means and a cleaning means for the ink jet head, and a pressure or suction means for the ink jet head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of ink jet heads to be mounted on a ink jet apparatus can be also changed. For example, only one ink jet head corresponding to a single color ink, or a plurality of ink jet heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method of printing on both surfaces or one surface of a sheet-shaped printing medium by using an ink jet head including a plurality of ink ejecting ports facing the sheet-shaped printing medium and energy generating elements for ejecting ink from the ejecting ports to the printing medium, the method comprising the steps of:

designating either of a both surface printing mode for printing on both surfaces of the printing medium and a one surface printing mode for printing on one surface of the printing medium;

selecting a low printing density when the both surface printing mode is designated, the printing density being selectable between a normal printing density and the low printing density lower than the normal printing density; and changing the printing density on the printing medium to the selected printing density.

2. An ink jet printing method as claimed in claim 1 wherein the normal printing density is selected in the case that the both surface printing mode is not designated.

3. An ink jet printing method as claimed in claim 2, wherein the step of changing the printing density on the printing medium comprises changing an ink amount per unit area which is ejected for printing, wherein reducing the ink amount per unit area reduces the printing density.

4. An ink jet printing method as claimed in claim 1, wherein the step of changing the printing density on the printing medium comprises changing an ink amount per unit area which is ejected for printing, wherein reducing the ink amount per unit area reduces the printing density.

5. An ink jet printing method as claimed in claim 4, wherein the printing density is reduced by thinning ink dots formed on the printing medium.

6. An ink jet printing method as claimed in claim 4, wherein the printing density is reduced by shortening a driving time duration of each energy generating element.

7. An ink jet printing method as claimed in claim 4, further comprising the step of detecting a temperature of the ink jet head, and maintaining the temperature of the ink jet head lower than that for the normal printing density so that the printing density is reduced.

8. An ink jet printing method as claimed in claim 7, further comprising the step of heating the ink jet head based on information on the temperature of the ink jet head.

9. An ink jet printing method as claimed in claim 1, wherein each energy generating element comprises an electrothermal transducer for generating thermal energy to cause film boiling in the ink.

10. An ink jet printing method as claimed in claim 1, further comprising the step of cancelling the low printing density selected by designating the both surface printing mode, and permitting selection of the normal printing density.

11. An ink jet printing method as claimed in claim 10, wherein the step of changing the printing density on the printing medium comprises changing an ink amount per unit area which is ejected for printing, wherein reducing the ink amount per unit area reduces the printing density.

12. An ink jet apparatus for printing on both surfaces or one surface of a sheet-shaped printing medium by using an ink jet head including a plurality of ink ejecting ports facing the printing medium and energy generating elements for ejecting ink to the printing medium, the apparatus comprising:

printing density changing means for changing a printing density on the printing medium;

both surface/one surface printing mode designating means for designating either of a both surface printing mode for printing on both surfaces of the printing medium and a one surface printing mode for printing on one surface of the printing medium;

printing density selecting means for selecting a low printing density when the both surface printing mode is designated by the both surface/one surface printing mode designating means, the printing density being selectable between a normal printing density and the low printing density lower than the normal printing density; and controlling means for controlling the printing density changing means so that the printing density becomes the printing density selected by the printing density selecting means.

13. An ink jet apparatus as claimed in claim 12, wherein the printing density changing means changes an ink amount per unit area which is ejected for printing, wherein reducing the ink amount per unit area reduces the printing density.

14. An ink jet apparatus as claimed in claim 13, wherein the printing density changing means reduces the printing density by thinning ink dots formed on the printing medium.

15. An ink jet apparatus as claimed in claim 13, wherein the printing density changing means reduces the printing density by shortening a driving time duration of each thermal energy generating element.

16. An ink jet apparatus as claimed in claim 13, further comprising temperature detecting means for detecting a temperature of the ink jet head, and wherein the printing density changing means reduces the printing density by maintaining the temperature of the ink jet head lower than that for the normal printing density.

17. An ink jet apparatus as claimed in claim 16, further comprising a subheater for heating the ink jet head based on information from the temperature detecting means.

18. An ink jet apparatus as claimed in claim 12, wherein each energy generating element comprises an electrothermal transducer for generating thermal energy to cause film boiling in the ink.

19. An ink jet apparatus as claimed in claim 12, further comprising means for cancelling the low printing density selected by the printing mode designating means, and permitting selection of the normal printing density.

20. An ink jet apparatus as claimed in claim 19, wherein the printing density changing means changes an ink amount per unit area which is ejected for printing, wherein reducing the ink amount per unit area reduces the printing density.

21. An ink jet apparatus as claimed in claim 10 or claim 11, wherein the normal printing density is selected by the printing density selecting means in the case that the both surface printing mode is not designated by the both surface/one surface printing mode designating means.

22. An ink jet apparatus as claimed in claim 21, wherein the printing density changing means changes an ink amount per unit area which is ejected for printing, wherein reducing the ink amount per unit area reduces the printing density.

* * * * *

UNITED STATES PATENT AND TRADEMARK OFFICE

CERTIFICATE OF CORRECTION

PATENT NO. : 5,742,301

DATED : April 21, 1998

INVENTOR(S) : FUNIHIKO IKEDA

It is certified that error appears in the above-identified patent and that said Letters Patent is hereby corrected as shown below:

COLUMN 10:

Line 19, "claim 1" should read --claim 1 or claim 10,--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*